United States Patent [19]

Moskowitz

[11] 4,021,148

[45] May 3, 1977

[54] HYDRAULIC FLUID DEVICES

[76] Inventor: Seymour Moskowitz, 36 Brandon St., Lexington, Mass. 02173

[22] Filed: July 16, 1975

[21] Appl. No.: 596,506

[52] U.S. Cl. ..... 417/383; 417/367

[51] Int. Cl.[2] ..... F04B 9/08

[58] Field of Search ..... 417/383, 384, 389, 390, 417/395, 388, 367, 394; 92/92

[56] References Cited

UNITED STATES PATENTS

| | | | |
|---|---|---|---|
| 1,389,635 | 9/1921 | Dunkle | 417/394 |
| 1,764,712 | 6/1930 | Brackett et al. | 417/439 X |
| 2,102,665 | 12/1937 | Allen | 417/383 |
| 2,505,198 | 4/1950 | Moskowitz et al. | 417/92 |
| 2,795,196 | 6/1957 | Moskowitz | 417/98 |
| 2,915,016 | 12/1959 | Weaver et al. | 417/388 |

*Primary Examiner*—William L. Freeh

*Assistant Examiner*—Edward Look

*Attorney, Agent, or Firm*—Morse, Altman, Oates & Bello

[57] ABSTRACT

A pump with a plunger assembly that is received within an outer housing containing a fluid. The plunger assembly includes a slidable sleeve portion defining a vertical channel. A pair of flexible membranes form outer and inner chambers within the vertical channel, one of the flexible membranes constituting a common wall that separates the chambers. A charging fluid is fed to the outer chamber through an inlet valve and exits therefrom through an exhaust valve. A fluid to be pumped is fed to the inner chamber through an inlet valve and exits therefrom through an exhaust valve. The charging fluid governs the interior profile within the vertical channel for providing variable pressure to volume ratios within the chambers.

6 Claims, 3 Drawing Figures

HYDRAULIC FLUID DEVICES

SUMMARY OF THE INVENTION

This invention relates to an improved construction of a pumping unit for circulating either fluids or gases.

One of the objects of this invention is to provide a hydraulic fluid device with a vertical channel of varying cross sectional area which contains a fluid or gas to be pumped by a second fluid which rises and falls in this channel.

Another object of this invention is to provide a pumping device for fluids or gases comprising a sealed container adapted to hold a dense fluid, a vertical plunger entering the container and a vertical channel within the plunger which is open at the bottom and valved at the top.

Another object of this invention is to provide a pumping device for fluids or gases comprising a sealed container adapted to hold a dense fluid, a vertical plunger entering the container and a vertical channel within the plunger open at the bottom and valved at the top, the vertical channel containing flexible membranes which form distinct free interior volumes or chambers, that completely contain the fluids or gases within them.

Another object of this invention is to provide a hydraulic fluid device for circulating either fluids or gases under variable pressure to volume ratios that may be predetermined or altered as desired with a given force operating the device during the course of a single pumping stroke.

Additional objects, advantages and features of invention reside in the construction, arrangement and combination of parts involved in the embodiment of the invention and its practice as will be understood from the following description and accompanying drawings wherein FIG. I is a vertical sectional view through the pumping unit.

FIG. II is a top plan view thereof. FIG. III is a vertical sectional view of the outer sleeve of the pump plunger.

DESCRIPTION OF THE PREFERRED EMBODIMENT

Figure 1:
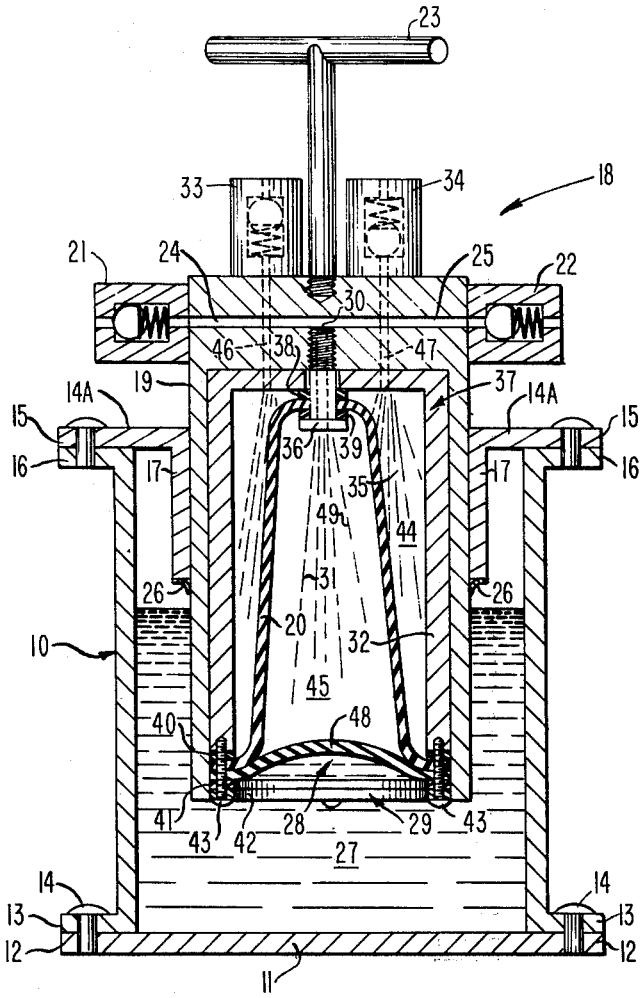
Figure 3:
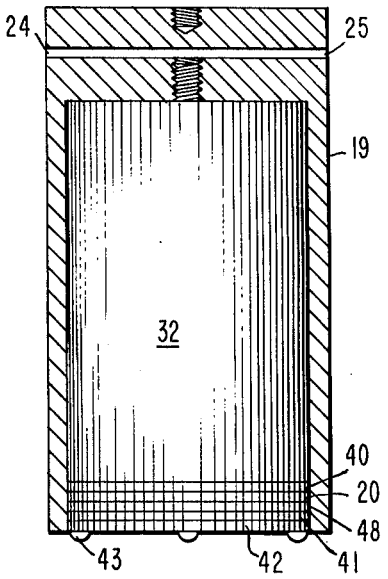

Referring to the drawings which illustrate a practical embodiment of the invention, 10 designates a container or cylinder which is provided with a bottom sleeve 11, detachably secured in place, as by the cooperating flanges 12 and 13 and the connecting bolts 14. A top closure 14A for the container 10 is detachably secured in place by the cooperating flanges 15 and 16 and the connecting bolts 14. A fixed cylindrical plunger guide 17 extends into the container 10 from the top closure 14A.

A pump plunger assembly 18, comprising an outer sleeve 19, an inner sleeve assembly 37, an intake valve 21, an exhaust valve 22, a charging valve 33, an exhaust valve 34 and a handle 23 which is one possible means to reciprocate the entire pump plunger assembly 18 which fits slidably into the fixed cylindrical plunger guide 17 and is sealed gas tight by the high pressure seal 26. The closed upper ends of the outer sleeve assembly 19 and the inner sleeve assembly 37 are connected to the intake valve 21 and exhaust valve 22 by channels 24, 30 and 25.

The inner sleeve assembly 37 is comprised of an inner sleeve 32, a connecting bolt 36 containing channel 30 which extends to the channels 24 and 25, cooperating gaskets 38 and 39 which are positioned about the connecting bolt 36 and a flexible membrane 20, a lower flexible membrane 48, cooperating gaskets 40 and 41, and plate 42. Connecting screws 43 detachably secure plate 42, flexible membrane 20, lower flexible membrane 48 and gaskets 40, 41 to the lower end of the inner sleeve 32. The connecting bolt 36 detachably secures the inner sleeve assembly 37 to the outer sleeve 19.

Referring further to the inner sleeve assembly 37 the flexible membranes 20 and 48 within a vertical channel 28 form two distinct free interior volumes or chambers 44 and 45 which completely contain the fluids or gases within them.

The chamber 44 is charged with fluid or gas 35 by means of the charging valve 33 and channel 46 and the fluid or gas is exhausted by means of the channel 47 and the exhaust valve 34.

The flexible membranes 20 and 48 may be composed of any suitable material and may be of any predetermined shape to form distinct free interior volumes or chambers with flexible walls within the vertical channel 28 of the pump plunger assembly 48 which completely contain the fluids or gases within them. The flexible membrane 20 is a common wall to both chambers. The chamber 44 may be charged with a fluid or gas 35 by means of the charging valve 33 and channel 46 and exhausted by means of the channel 47 and the exhaust valve 34 to achieve a desired interior profile within the plunger assembly 48 at any instant of time which may be varied instantaneously and at will, depending on the pressure and amount of the charging fluid or gas that is used and the flexibility of the membrane or the ability of the membrane to stretch.

The pressure within the chamber 44 should preferably be greater than the pressure in the chamber 45, so that the membrane 20 is the less flexible or stiffer wall of the chamber 45 which contains the fluid or gas 49 to be pumped.

The container 10 is filled with a fluid 27 to such a level that, at the top of the stroke of the plunger assembly, the bottom of the vertical channel 28 is immersed in the fluid 27. The vertical channel 28 may vary in cross sectional area from the open lower end 29 to the closed and valved upper end 30. Above the fluid 27 and within the chamber 45 is the fluid or gas 49 which is being circulated.

As the plunger assembly 18 shown in FIG. I is moved downwardly, the pumped fluid or gas 49 is displaced from the chamber 45 as the fluid 27 rises through plate 42 in a channel 28 because pressure is being exerted upon all of the fluids; the fluid 27, the pumped fluid and the charging fluid 25. This pressure can only be relieved as the pumped fluid escapes through the exhaust valve 22.

As the plunger assembly 18 shown in FIG. I is moved upwardly, the pumped fluid or gas 49 is drawn into the channels 24, 30 and chamber 45 because pressure is reduced until the partial vacuum thus formed is relieved as the pumped fluid or gas flows in through the intake valve 21.

As the fluid 27 rises and falls in the channel 28, drawing in and then exhausting the pumped fluid or gas 49 through the intake valve 21 and exhaust valve 22, the cross sectional area of the chamber 45 may be varied instantaneously and at will by means of simultaneously employing the charging valve 33 and relief or exhaust valve 34 to determine the pressure and amount of the charging fluid or gas 35 that is employed, thereby causing the flexible membrane 20 to expand or stretch as the fluid 27 rises and falls in the channel. Additionally, the relief valve 34 may be used to discharge the fluid or gas from within the chamber 45, allowing the flexible membrane to relax to some desired intermediate profile as a predetermined amount of fluid or gas is released, or the charging valve 33 may be employed to charge the fluid or gas within the chamber 45 to a higher pressure to cause the flexible membrane 20 to expand or stretch to achieve a desired interior profile within the channel. Therefore, if the surface of the fluid 27 on the lower flexible membrane 48 is considered as a piston face doing work on the pumped fluid 49 in the channel 28, a given amount of force on this piston face may either pump a smaller amount of the pumped fluid at a higher pressure or a larger amount of the pumped fluid at a lower pressure depending on the cross sectional area of the chamber 45 which may be varied instantaneously and at will and which determines the area of the hypothetical piston face. Therefore, as the configuration of the chamber 45 varies, this pump may have different and variable pressure to volume ratios in the different parts of a single stroke that may be predetermined or altered as desired in the different parts of a single stroke while a given force or thrust moves the piston which is the surface of the fluid 27 upon the lower flexible membrane 48 in the channel 28.

A wide selection of flexible membranes may be used with any given pump plunger assembly. The flexible membranes are replaceable within the pump plunger assembly if they tear or leak and any desired shape of flexible membrane of any desired material or combination of materials may be used at any given time to achieve a desired interior profile when charged or inflated with a charging fluid or gas. The flexible membranes may be formed by any suitable fabrication process, as for instance, they may be molded or they may be cut, formed and joined together by adhesive bonding or a vulcanizing process may be employed. The flexible membranes may be thermally conductive to conduct heat away from or transmit heat to the pumped fluid or gas employing the fluid 27 as either a heat sink or a heat source or by employing the charging fluid as either a heat sink or a heat source or by simultaneously employing both the charging and working fluids as heat sinks and/or heat sources to establish any desired thermal gradient within the fluid or gas being circulated. The thermal conductivity of the flexible membranes may thus be used to affect the stale point (pressure, volume, temperature) of the fluid or gas being pumped or circulated.

There are two necessary characteristics of fluid 27 and the charging fluid or gas 35 and the pumping fluid 49. The first is that the fluid within 27 the container be of greater density than the pumped fluid or gas 49 and the second is that all of the fluids or gases employed not mix or react in a harmful manner with each other or with the flexible membranes. Some examples of contemplated fluids and charging fluids would be mercury pumping oil, water or air. Water could be used as the fluid within the container and as the charging fluid to pump light oils, or it could be used to pump air or oxygen. It is to be understood that there are any number of possible combinations of fluids within the container and charging fluids or gases and pumped fluids or gases that may be used to practice this invention.

FIG. I shows one contemplated embodiment of my invention. FIG. III shows the pump plunger outer sleeve 19 which may be fabricated from metal or other suitable material by any standard precision means.

Having illustrated and described three preferred embodiments of my invention, it is to be understood that it is not limited to the precise construction herein disclosed and the right is reserved to all changes and modifications coming within the scope of the invention as defined in the appended claims.

I claim:

1. A hydraulic fluid device comprising a closed container, a guide sleeve at an upper section of said container, a fluid within said container, plunger means received within said sleeve and constrained for movement relative to said sleeve; means for moving said plunger means within said container and said fluid, said plunger means including a vertical channel and flexible membrane means, said flexible membrane means forming at least first and second chambers within said vertical channel, said second chamber within said first chamber, said first chamber constituting a charging chamber and said second chamber constituting a pumping chamber, first inlet means and first outlet means communicating with said charging chamber, second inlet means and second outlet means communicating with said pumping chamber, said second inlet means and said second outlet means including valve means at least a portion of said flexible means constituting a common wall between said charging chamber and said pumping chamber, a fluid to be pumped entering said pumping chamber through said second inlet means and exiting said pumping chamber through said second outlet means, a charging fluid entering said charging chamber through said first inlet means and exiting said charging chamber through said second inlet means, at least a portion of said flexible membrane means disposed between said fluid in said container and said fluid to be pumped, at least a portion of said flexible membrane means disposed between said fluid to be pumped and said charging fluid, variable pressure to volume ratios are provided by controlling said charging fluid entering and exiting said charging chamber as said plunger means moves within said container and said fluid to be pumped enters said pumping chamber, through said second inlet means and exits said pumping chamber through said second outlet means.

2. A hydraulic fluid device comprising a closed container, a guide sleeve at an upper section of said container, a fluid within said container, plunger means received within said sleeve and constrained for movement relative to said sleeve; means for moving said plunger means within said container and said fluid, said plunger means including a vertical channel and flexible membrane means, said flexible membrane means forming at least first and second chambers within said vertical channel, said second chamber within said first chamber, said first chamber constituting a charging chamber and said second chamber constituting a pumping chamber, first inlet means and first outlet means communicating with said charging chamber, second inlet means and second outlet means communicating with said pumping chamber, said second inlet means and said second outlet means including valve means at least a portion of said flexible means constituting a common wall between said charging chamber and said pumping chamber, a fluid to be pumped entering said pumping chamber through said second inlet means and exiting said pumping chamber through said second outlet means, a charging fluid entering said charging chamber through said first inlet means and exiting said charging chamber through said second inlet means, at least a portion of said flexible membrane means disposed between said fluid in said container and said fluid to be pumped, at least a portion of said flexible membrane means disposed between said fluid to be pumped and said charging fluid, variable pressure to volume ratios are provided by controlling said charging fluid entering and exiting said charging chamber as said plunger means moves within said container and, said fluid to be pumped enters said pumping chamber through said second inlet means and exits said pumping chamber through said second outlet means, said charging fluid within said charging chamber at a pressure which is higher than the pressure of said pumping fluid within said pumping chamber.

3. A hydraulic fluid device comprising a closed container, a guide sleeve at an upper section of said container, a fluid within said container, vertical plunger means coaxially disposed within said sleeve and constrained for movement relative to said sleeve, means for moving said plunger means within said container and said fluid, said plunger means including a vertical channel and at least first and second flexible membrane means, said first and second flexible membrane means forming at least first and second chambers within said vertical channel, said second chamber within said first chamber constituting a charging chamber and said second chamber constituting a pumping chamber, said first flexible membrane means constituting a common wall between said charging chamber and said pumping chamber, said second flexible membrane means constituting a common wall between said container and said pumping chamber, first inlet means and first outlet means communicating with said charging chamber, second inlet means and second outlet means communicating with said pumping chamber, said second inlet means and said second outlet means including valve means a fluid to be pumped entering said pumping chamber through said second inlet means and exiting said pumping chamber through said second outlet means, a charging fluid entering said charging chamber through said first inlet means and exiting said charging chamber through said second inlet means, variable pressure to volume ratios are provided by controlling said charging fluid entering and exiting said charging chamber as said plunger means moves within said container and said fluid to be pumped enters said pumping chamber through said second inlet means and exits said pumping chamber through said second outlet means.

4. A hydraulic fluid device comprising a closed container, a guide sleeve at an upper section of said container, a fluid within said container, vertical plunger means coaxially disposed within said sleeve and constrained for movement relative to said sleeve, means for moving said plunger means within said container and said fluid, said plunger means including a vertical channel and at least first and second flexible membrane means, said first and second flexible membrane means forming at least first and second chambers within said vertical channel, said second chamber within said first chamber, said first chamber constituting a charging chamber and said second chamber constituting a pumping chamber, said first flexible membrane means constituting a common wall between said charging chamber and said pumping chamber, said second flexible membrane means constituting a common wall between said container and said pumping chamber, first inlet means and first outlet means communicating with said charging chamber, second inlet means and second outlet means communicating with said pumping chamber, said second inlet means and said second outlet means including valve means a fluid to be pumped entering said pumping chamber through said second inlet means and exiting said pumping chamber through said second inlet means and exiting said pumping chamber through said second outlet means, a charging fluid entering said charging chamber through said first inlet means and exiting said charging chamber through said second inlet means, variable pressure to volume ratios are provided by controlling said charging fluid entering and exiting said charging chamber as said plunger means moves within said container and said fluid to be pumped enters said pumping chamber through said second inlet means and exits said said pumping chamber through said second outlet means, said charging fluid within said charging chamber at a pressure which is higher than the pressure of said pumping fluid within said pumping chamber.

5. A hydraulic fluid device comprising a closed container, a guide sleeve at an upper section of said container, a fluid within said container, vertical plunger means coaxially disposed within said sleeve and constrained for vertical movement relative said sleeve; means for vertically moving said plunger means within said container, said plunger means closed at its upper end and opened at its bottom end, said plunger means including a vertical channel and first and second flexible membrane means, said first and second flexible membrane means forming first and second sealed chambers within said vertical channel, said second chamber within said first chamber, said first chamber constituting a charging chamber and said second chamber constituting a pumping chamber, said first flexible membrane means constituting a common wall between said charging chamber and said pumping chamber, said second flexible membrane means constituting a common wall between said pumping chamber and said container, said second flexible means sealing said opened end of said plunger means, said fluid in contact with said second flexible membrane means, first inlet means and first outlet means communicating with said charging chamber, second inlet means and second outlet means communicating with said pumping chamber, said second inlet means and said second outlet means including valve means a fluid to be pumped entering said pumping chamber through said second inlet means and exiting said pumping chamber through said second outlet means, a charging fluid entering said charging chamber through said first inlet means and exiting said charging chamber through said second inlet means, variable pressure to volume ratios are provided by controlling said charging fluid entering and exiting said charging chamber as said plunger means moves within said container and a pumped fluid enters said pumping chamber through said second inlet means and exits said pumping chamber through said second outlet means.

6. A hydraulic fluid device comprising a closed container, a guide sleeve at an upper section of said container, a fluid within said container, vertical plunger means coaxially disposed within said sleeve and constrained for vertical movement relative said sleeve, means for vertically moving said plunger means within said container, said plunger means closed at its upper end and opened at its bottom end, said plunger means including a vertical channel and first and second flexible membrane means, said first and second flexible membrane means forming first and second sealed chambers within said vertical channel, said second chamber within said first chamber, said first chamber constituting a charging chamber and said second chamber constituting a pumping chamber, said first flexible membrane means constituting a common wall between said charging chamber and said pumping chamber, said second flexible membrane means constituting a common wall between said pumping chamber and said container, said second flexible means sealing said opened end of said plunger means, said fluid in said container in contact with said second flexible membrane means, first inlet means and first outlet means communicating with said charging chamber, second inlet means and second outlet means communicating with said pumping chamber, said second inlet means and said second outlet means including valve means a fluid to be pumped entering said pumping chamber through said second inlet means and exiting said pumping chamber through said second outlet means, a charging fluid entering said charging chamber through said first inlet means and exiting said charging chamber through said second inlet means, variable pressure to volume ratios are provided by controlling said charging fluid entering and exiting said charging chamber as said plunger means moves within said container and a pumped fluid enters said pumping chamber through said second inlet means and exits said pumping chamber through said second outlet means, said charging fluid within said charging chamber at a pressure which is higher than the pressure of said pumping fluid within said pumping chamber.

* * * * *

UNITED STATES PATENT OFFICE
CERTIFICATE OF CORRECTION

PATENT NO. : 4,021,148

DATED : May 3, 1977

INVENTOR(S) : Seymour Moskowitz

Figure 2:
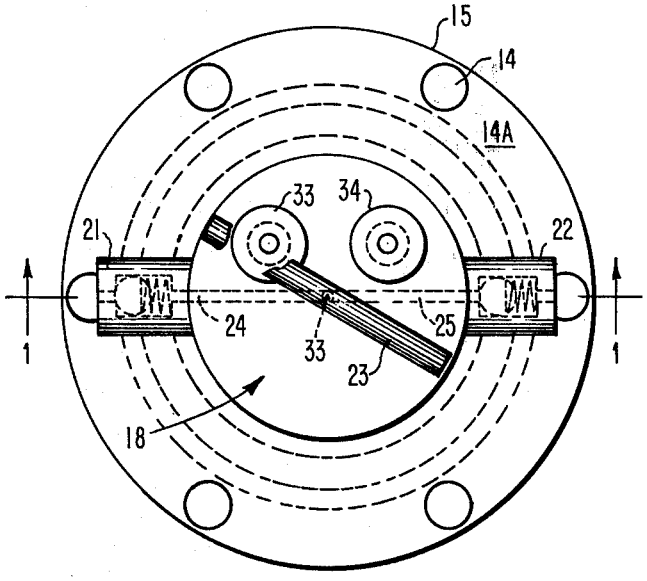

It is certified that error appears in the above-identified patent and that said Letters Patent are hereby corrected as shown below:

In the drawing, Fig. 2, the reference numeral 33 applied to the center of handle 23 should be reference numeral 30.
Column 2, line 24, "48" should read -- 18 --; line 31, "48" should read -- 18 --; and line 54, "25" should read -- 35 --.
Claim 1, column 4, line 36, "second inlet" should read -- first outlet --
Claim 2, column 5, line 4, "second inlet" should read -- first outlet --
Claim 3, column 5, line 46,"second inlet" should read -- first outlet --
Claim 4, column 6, line 12,"second inlet" should read -- first outlet --
Claim 5, column 6, line 54,"second inlet" should read -- first outlet --
Claim 6, column 8, line 8,"second inlet" should read -- first outlet --

Signed and Sealed this

Thirtieth Day of May 1978

[SEAL]

Attest:

RUTH C. MASON
Attesting Officer

LUTRELLE F. PARKER
Acting Commissioner of Patents and Trademarks